US008096240B2

(12) United States Patent
Glunz et al.

(10) Patent No.: US 8,096,240 B2
(45) Date of Patent: Jan. 17, 2012

(54) METHOD FOR HANDLING PRINTING PLATES

(75) Inventors: Wolfgang Glunz, Augsburg (DE); Albert Heller, Pestenacker (DE); Georg Kassmair, Zusamzell (DE); Michael Scholz, Muensterhausen (DE)

(73) Assignee: manroland AG, Offenbach am Main (DE)

( * ) Notice: Subject to any disclaimer, the term of this patent is extended or adjusted under 35 U.S.C. 154(b) by 437 days.

(21) Appl. No.: 12/467,408

(22) Filed: May 18, 2009

(65) Prior Publication Data

US 2009/0288570 A1 Nov. 26, 2009

(30) Foreign Application Priority Data

May 20, 2008 (DE) ..... 10 2008 024 402

(51) Int. Cl.
*B41F 27/12* (2006.01)

(52) U.S. Cl. ..... 101/477; 101/415.1

(58) Field of Classification Search ..... 101/378, 101/382.1, 383, 401.1, 415.1, 477
See application file for complete search history.

(56) References Cited

U.S. PATENT DOCUMENTS

| | | | | |
|---|---|---|---|---|
| 3,425,687 | A * | 2/1969 | Williams | 271/265.01 |
| 3,914,974 | A * | 10/1975 | DeVore | 72/319 |
| 4,178,097 | A * | 12/1979 | Sara | 355/100 |
| 4,978,117 | A | 12/1990 | Maier et al. | |
| 7,225,737 | B2 * | 6/2007 | Gelbart et al. | 101/463.1 |
| 2007/0272105 | A1 * | 11/2007 | Burgess et al. | 101/477 |

FOREIGN PATENT DOCUMENTS

| | | |
|---|---|---|
| DE | 102 20 424 | 6/2003 |
| DE | 10 2004 061 135 | 9/2005 |
| DE | 10 2006 032 204 | 10/2007 |
| EP | 0 336 904 | 10/1989 |

* cited by examiner

*Primary Examiner* — Ren Yan
(74) *Attorney, Agent, or Firm* — Cozen O'Connor

(57) ABSTRACT

Exposed printing plates are bent in the area of a bending device to form a leading end and a trailing end. Each exposed and bent printing plate is grasped in the area of the bending device at the leading end or at the trailing end of the printing plate by means of a gripping bar and transferred together with the gripping bar to a transporting device. The transporting device transports the printing plate together with the gripping bar toward a printing press, where the printing plate is removed together with the gripping bar from the transporting device in the area of the printing press. While grasped by the gripping bar, the plate is transferred to a form cylinder of a printing mechanism of the printing press.

6 Claims, 7 Drawing Sheets

METHOD FOR HANDLING PRINTING PLATES

BACKGROUND OF THE INVENTION

1. Field of the Invention

The invention is directed to a method for handling printing plates wherein an exposed printing plate is bent in a bending device to form a leading end and a trailing end, transported to a printing press, and clamped to a form cylinder of a printing mechanism.

2. Description of the Related Art

Rotary printing presses have printing units with a plurality of printing mechanisms. For example, printing units in rotary printing presses conventionally have two or four printing mechanisms, each printing mechanism comprising a form cylinder on which at least one printing plate is mounted. The printing plates to be mounted on the form cylinders of the printing mechanisms of a rotary printing press are exposed in the area of an exposure device and, after exposure, are bent in the area of a bending device so as to form a leading end and a trailing end. After the exposed printing plates are bent in the area of the bending device, it is necessary to guide the printing plates coming from the bending device to the printing press, namely, to the printing mechanisms themselves, so that the printing plates can be mounted on the form cylinders of the printing mechanisms. Difficulties arise in handling the printing plates particularly when large-format printing plates with a large axial width are used because there is a risk that the printing plates will be damaged during handling between the bending device and the form cylinders of the printing mechanisms. Therefore, there is a need for a method for handling printing plates by which even large-format printing plates can be handled between a bending device and the form cylinders of the printing mechanisms without the risk of damage.

SUMMARY OF THE INVENTION

On this basis, an object of the present invention is to provide a method for handling printing plates by which printing plates can be handled without the risk of damage.

According to the invention, every exposed and bent printing plate is grasped in the area of the bending device at the leading end or at the trailing end of the printing plate by a gripping bar, also known as a lock-up bar or clamping bar, and while grasped at the gripping bar is transferred together with the gripping bar to a transporting device which transports the respective printing plate together with the gripping bar in direction of the printing press, and the respective printing plate is removed together with the gripping bar from the transporting device in the area of the printing press and while grasped by the gripping bar is supplied to a form cylinder of a printing mechanism of the printing press.

The present invention makes it possible to handle even large-format printing plates between the bending device and the printing mechanisms of a printing press without the risk of damage to the printing plates.

Preferred further developments of the invention are indicated in the following description. An embodiment example of the invention, which is not limited thereby, will be described more fully with reference to the drawings.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
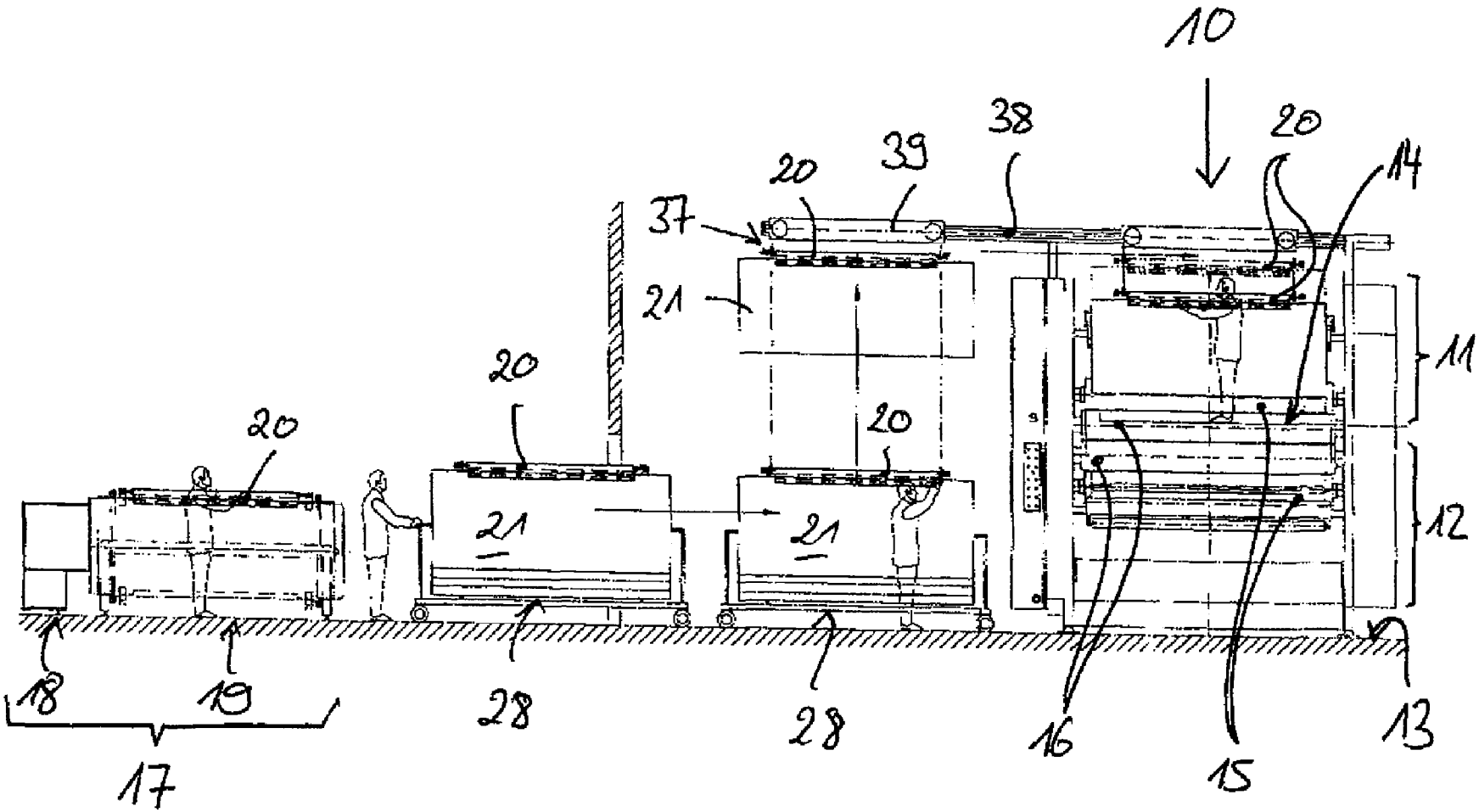
FIG. 1 is a schematic view of a printing unit of a rotary printing press together with a printing plate transporting trolley and a bending device to illustrate the method, according to the invention, for handling printing plates.
Figure 4:
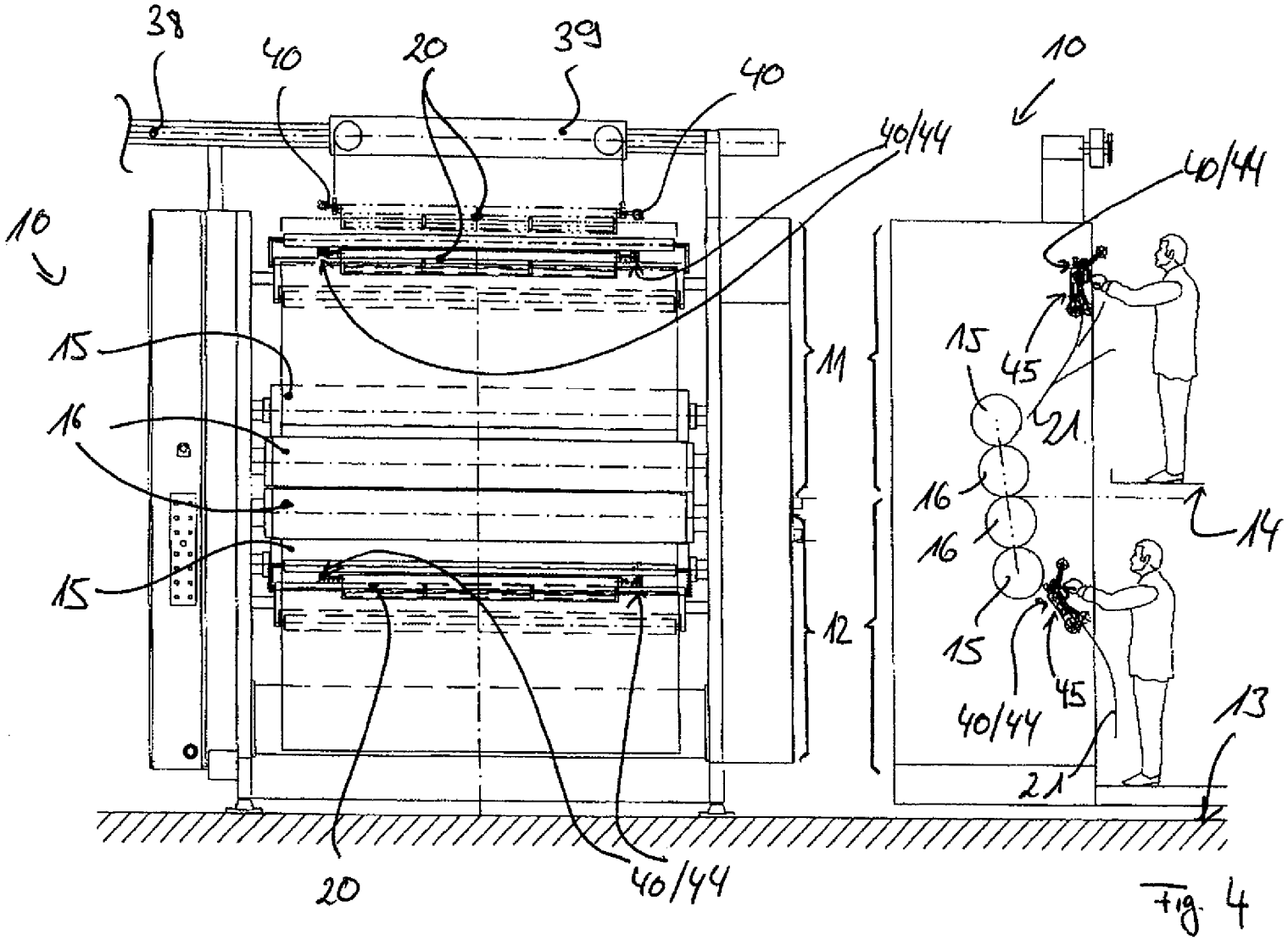
FIG. 4 shows another detail from FIG. 1 in the area of the printing unit.

FIG. 1 shows a schematic view of a printing unit 10 of a rotary printing press which, as can be seen from FIG. 4, includes two printing mechanisms 11, 12 positioned one above the other. A lower printing mechanism 12 is accessible from a shop floor 13 while an upper printing mechanism 11 is accessible from a gallery level 14 positioned above the shop floor 13. The printing unit 10 shown in the drawing is that of an illustration printing press in which a substrate to be printed is moved in horizontal direction through the printing unit 10. FIG. 4 shows form cylinder 15 and transfer cylinder 16 of the printing mechanisms 11, 12 of the printing unit 10. The transfer cylinders 16 of the printing mechanisms 11, 12 roll against one another while forming a printing gap for the substrate to be printed.

Printing plates are clamped to the form cylinders 15 of the printing mechanisms 11, 12 of the printing unit 10. The printing plates are bent in the area of a bending device 17 at a leading end and a trailing end. The bending device 17 includes a bending machine 18 and a bending table 19, shown in FIG. 5. In the area of the bending machine 18, exposed printing plates are bent in the area of the leading end and trailing end. The bending table 19 serves at least for handling the bent printing plates directly following the bending machine 18, namely, for removing the bent printing plates from the bending machine 18. If required, the bending table 19 also serves for handling printing plates which are not yet bent in order to guide the latter to the bending machine 18 for bending.

The printing plates which are bent in the area of the bending device 17 must be guided to the printing mechanisms 11, 12 of the printing unit 10 as they emerge from the bending device 17 so that they can be clamped to the form cylinders 15 of the printing mechanisms 11, 12. Within the meaning of the present invention, it is suggested that every printing plate which is bent in the area of the bending device 17 is grasped at its leading end or trailing end by a gripping bar 20, also known as a lock-up bar or clamping bar, and while grasped by the gripping bar 20, is transferred together with the gripping bar 20 to a transporting device. By means of the transporting device, the respective printing plate is transported together with the gripping bar 20 in direction of the printing mechanism 10 of the printing press. The respective printing plate is removed from the transporting device together with the gripping bar 20 in the area of the printing mechanism 10 and, while grasped by the gripping bar 20, is guided to a form cylinder 15 of a printing mechanism of the printing unit 10.

Figure 2:
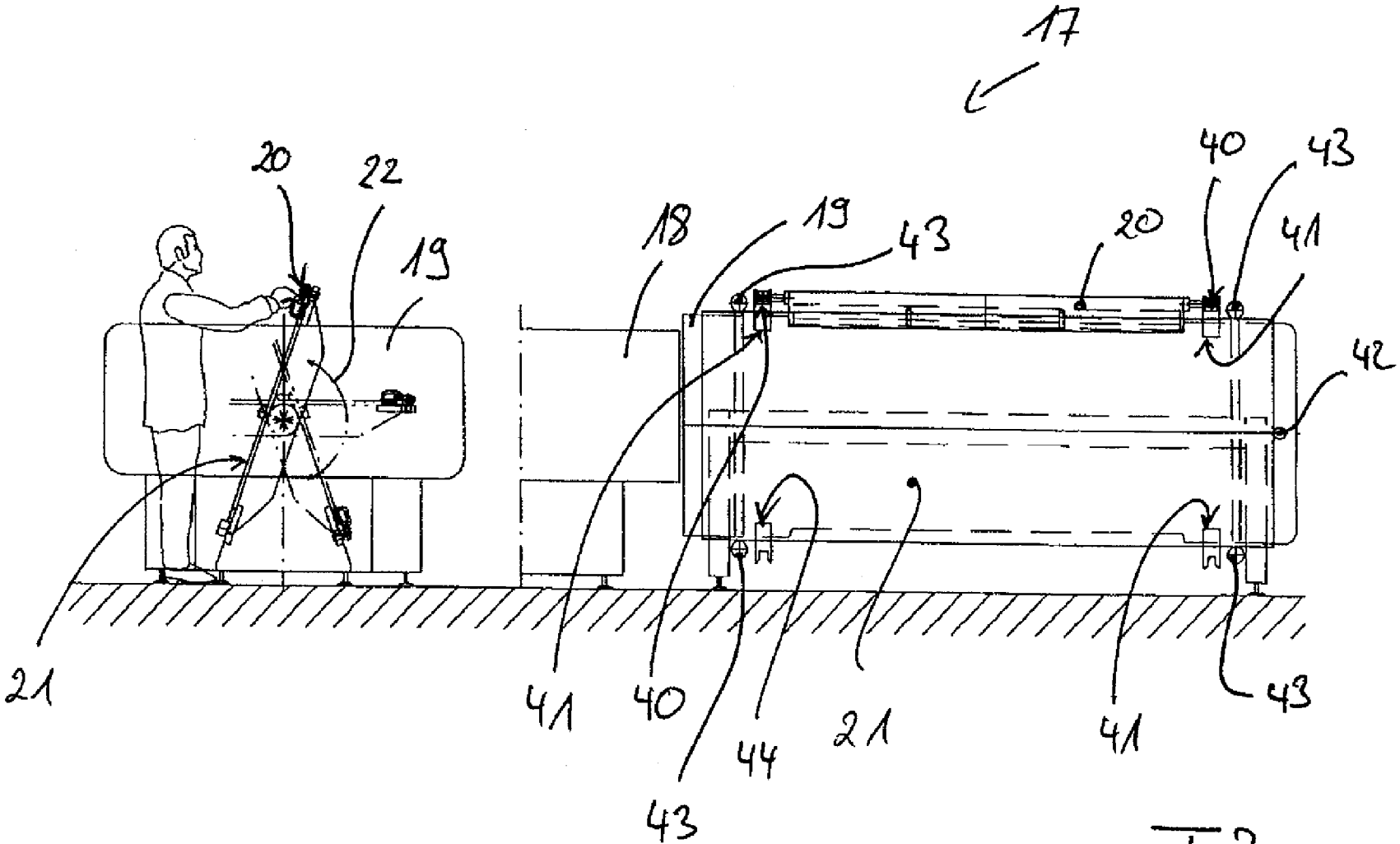
FIG. 2 shows a detail from FIG. 1 in the area of the bending device.

As can be seen most clearly from FIG. 2, every bent printing plate 21, starting from a horizontal position, is swiveled into the transfer position shown in FIG. 2 in the area of the bending table 19, which is constructed so as to be swivelable, in such a way that the respective printing plate 21 can be grasped by the gripping bar 20 at the swiveled up edge, namely, at the leading edge or at the trailing edge. The printing plate 21 which is grasped in this way is then transferred to the transporting device together with the gripping bar 20, namely, in such a way that direct contact between the respective printing plate 21 and the transporting device is prevented. The swiveling of the bending table 19 is illustrated in FIG. 2 by a double arrow 22.

The gripping bar 20 serves to grasp the printing plate 21 correctly with respect to register in the area of the bending device 17 at the leading edge or trailing edge of the printing plate 21. The gripping bar 20 includes a device by which the printing plate 21 is fixed in a flat manner by frictional and positive engagement to a surface region thereof extending adjacent to the leading edge or trailing edge of the printing plate 21. This flat, frictionally engaging fixation ensures that the printing plate 21 is stiffened and, therefore, stabilized in the area of the gripping bar 20 so that there is no risk that the printing plate 21 will buckle owing to its own weight when handled by the gripping bar 20. The device of the gripping bar 20 for fixing in a flat, frictionally engaging manner is formed by two clamping legs 23, 24 (see FIGS. 2*a*, 2*b*). The clamping legs 23, 24 are connected to one another by spring elements 25 and mounted so that they can be swiveled relative to one another against the spring force of the spring elements 25. When the clamping legs 23, 24 are swiveled relative to one another against the spring force provided by the spring elements 25, a clamping area 26 defined by the clamping legs 23, 24 is opened for inserting a printing plate 21 to be handled by the gripping bar 20. The clamping area 26 can then be closed by the spring force of the spring elements 25 so that a printing plate 21 inserted into the clamping area 26 is fixed by frictional engagement. Handling grips 27 are associated with the gripping bar 20. The operator can grasp the gripping bar 20 by means of the handling grips 27, that is, particularly when a printing plate 21 is fixed to the gripping bar 20. The handling grips 27 are associated with one of the clamping legs 23.

The gripping bar 20 includes a device for grasping the printing plate 11 correctly with respect to register. The device for grasping the printing plate 11 in correct register has guide pins 40 formed at both sides of the clamping legs 23, 24.

Figure 2A:
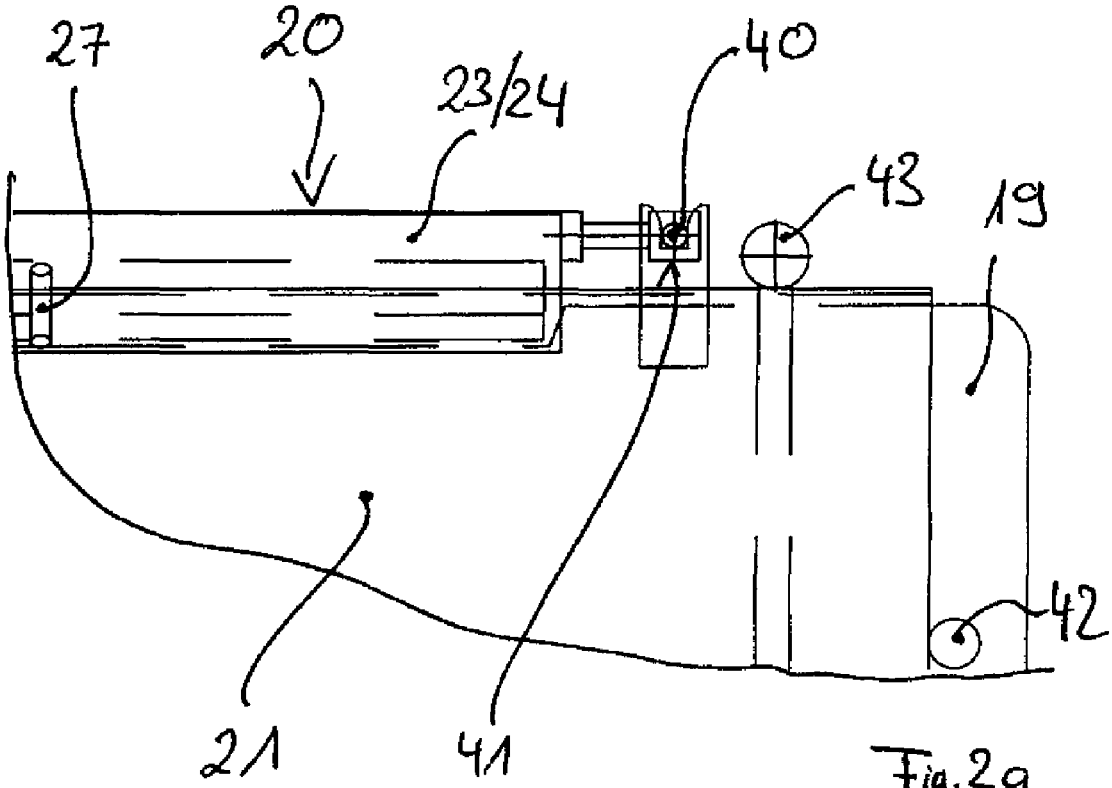
FIGS. 2*a*, 2*b* show details of the view according to FIG. 2.
Figure 2B:
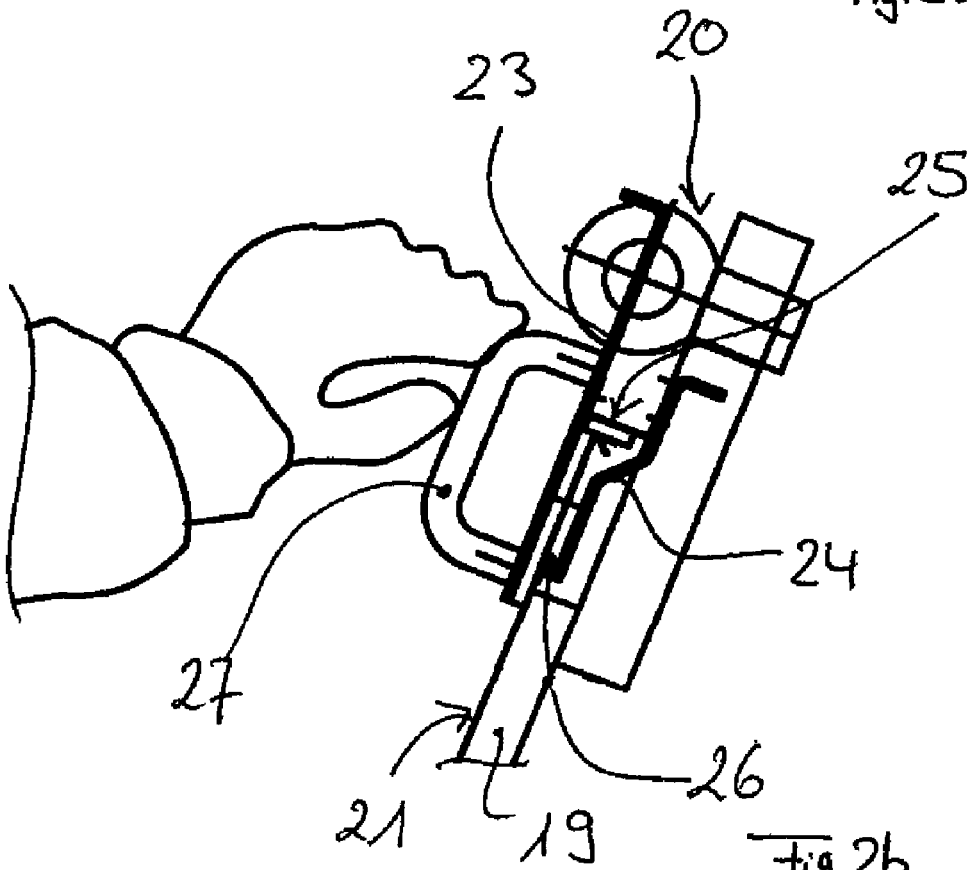

As is shown in FIGS. 2 and 2*a*, the guide pins 40 can be inserted into guide grooves 41 of the bending table 19 in such a way that a printing plate 21 which is held ready at the bending table 19 is received in the clamping legs 23, 24 in correct register. According to FIGS. 2, 2*a*, a printing plate 21 to be received by the gripping bar 20 is aligned in correct register at stops 42, 43 of the bending table 19. The printing plate 21 which is aligned in correct register at the bending table 19 is then received in correct register in the gripping bar 20 by means of the cooperation of the guide pins 40 of the gripping bar 20 and the guide grooves 41 of the bending table 19.

Figure 4A:
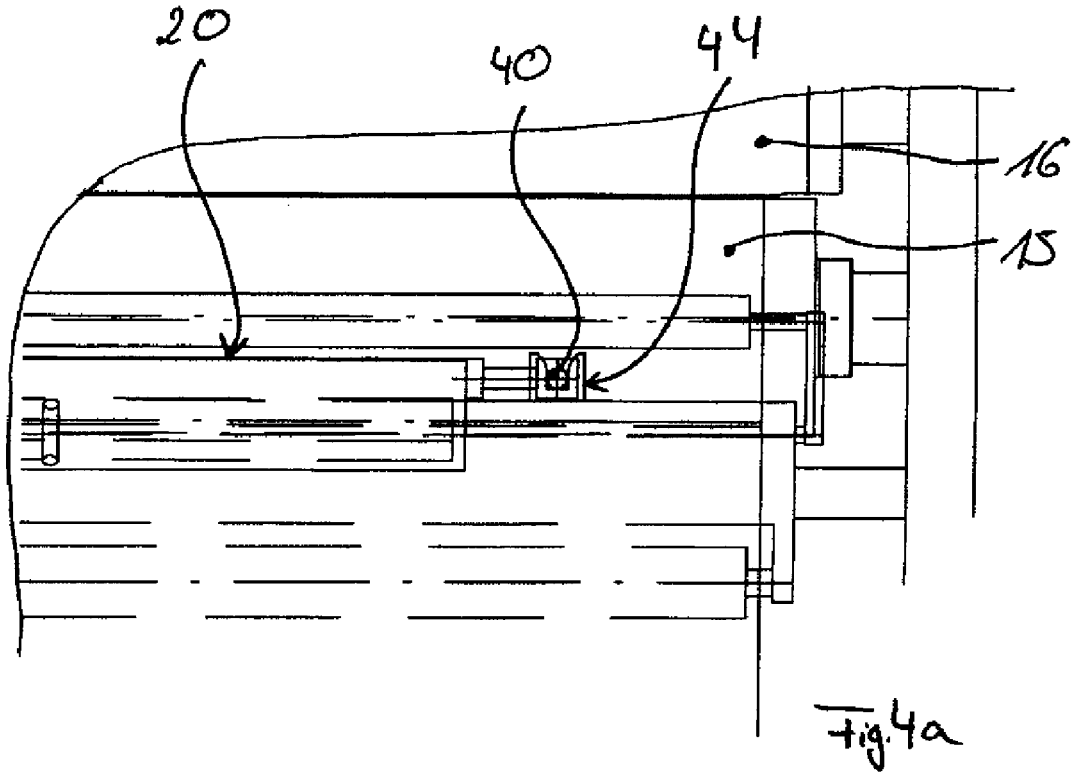
FIGS. 4*a*, 4*b* show details from the view in FIG. 4.
Figure 4B:
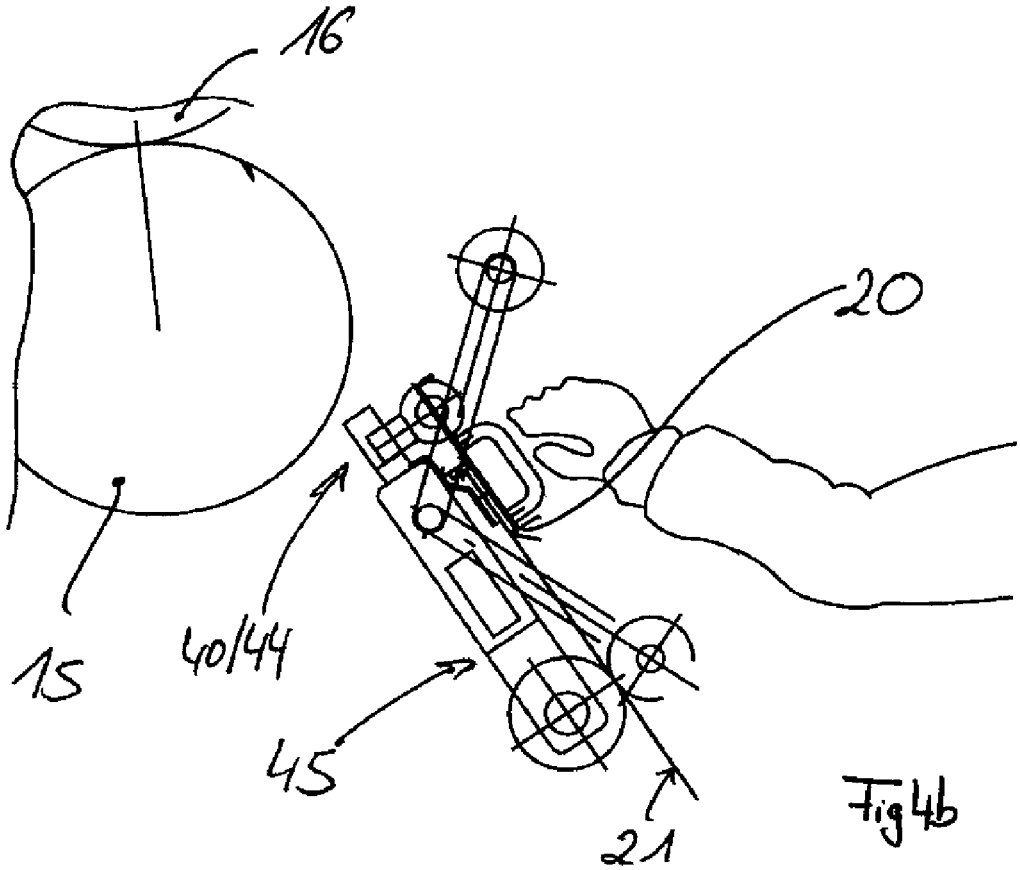

A printing plate 21 received in correct register in the gripping bar 20 remains aligned in correct register in the gripping bar 20 along the entire transporting path until the printing plate 21 is transferred to a printing mechanism of a printing press. When the printing plate 21 is transferred to a printing mechanism of a printing press, the guide pins 40 of the gripping bar 20 can be inserted (see FIG. 4*a*) into guide grooves 44 of a printing mechanism in such a way that a printing plate received in correct register in the clamping legs 23, 24 of the gripping bar 20 is transferred to the printing mechanism in correct register, namely, in correct lateral register and in correct diagonal register.

In the embodiment example shown in FIG. 1, a printing plate 21 fixed to a gripping bar 20, after removal from the bending table 19, is suspended in a printing plate transporting trolley 28 without coming into contact with the printing plate transporting trolley 28 so that the plate 21 cannot be damaged by the latter. The printing plate 21 fixed to the gripping bar 20 is transported from the bending device 17 in direction of the printing unit 10 by means of the printing plate transporting trolley 28.

Figure 3:
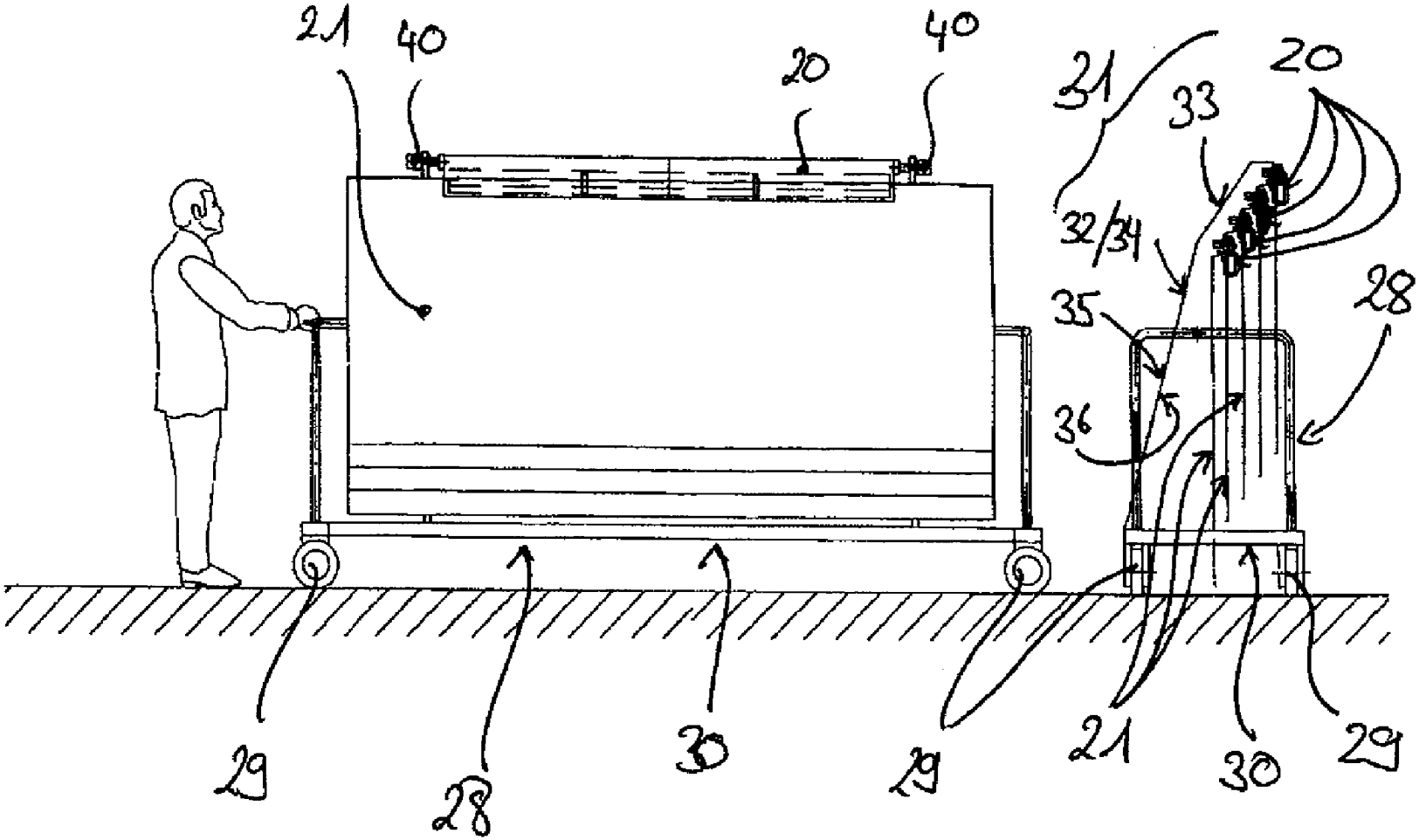
FIG. 3 shows a detail from FIG. 1 in the area of the printing plate transporting trolley.

FIG. 3 shows two different views of the printing plate transporting trolley 28 used for transporting printing plates 21. The printing plate transporting trolley 28 has a trolley platform 30 mounted on wheels 29.

An angled mounting frame 31 having two portions 32, 33 which are angled relative to one another is fastened to the trolley platform 30 of the printing plate transporting trolley 28. A stacking plate 34 which is mounted at an inclination on the trolley platform 30 to form an oblique plane is fastened to a lower portion 32 of the mounting frame 31. Printing plates which are not bent can be positioned to form a stack on the side 35 of the stacking plate 34 that encloses an angle of greater than 90° with a horizontal plane of the trolley platform 30.

The upper portion 33 of the mounting frame 31 is angled in such a way relative to the lower portion 32 at which the support plate 34 is mounted that the upper portion 33 of the mounting frame 31 is slants away from the support plate 34. Holding devices on which bent printing plates 21 are suspended by the gripping bar 20 together with the gripping bar 20 are fastened to the upper portion 33 of the mounting frame 31. Bent printing plates 21 are accordingly suspended in the area of the side 36 of the stacking plate 34 that encloses an angle of less than 90° with the horizontal plane of the trolley platform 30. A plurality of bent printing plates 21 can be suspended at the holding devices so as to extend parallel to one another.

As is shown in FIG. 1, printing plates 21 which are suspended at the printing plate transporting trolley 28 by the gripping bars 20 in the manner described above are transported in direction of the printing unit 10 of the printing press by means of the printing plate transporting trolley. A printing plate 21 which is to be clamped to the form cylinder 15 of the printing mechanism 12 which is accessible from the shop floor 13 is then removed from the printing plate transporting trolley 28 by the gripping bar 20 and can be guided directly to the form cylinder 15 of the printing mechanism 12 and clamped on the form cylinder 15.

A printing plate 21 to be clamped on the form cylinder 15 of the printing mechanism 11 which is accessible from the gallery level 14 is likewise removed from the printing plate transporting trolley 28 by the gripping bar 20 and is initially transferred to a lifting device 37 for lifting the printing plate 21 to the level of the gallery 14. The lifted printing plate 21 is then moved again in horizontal direction and accordingly guided to the printing mechanism 11 for subsequently clamping on the form cylinder 15 of this printing mechanism 11. The movement of the lifted printing plate 21 in horizontal direction is carried out by means of a carriage 39 engaging a rail 38.

When the printing plates 21 are shifted into the area of the printing mechanisms 11, 12 on whose form cylinders 15 they are to be clamped, the respective printing plate 21 is guided to the respective form cylinder 15 in correct register in such a way that the printing plate 21 is suspended by the guide pins 40 of the gripping bar 20 at the guide grooves 44 (see FIG. 4) positioned in the area of the respective printing mechanism. After being released by the gripping bar 20, the printing plate 21 can be clamped to the form cylinder 15 of the respective printing mechanism 11, 12 by a printing plate changing device 45 (see FIG. 4).

Figure 5:
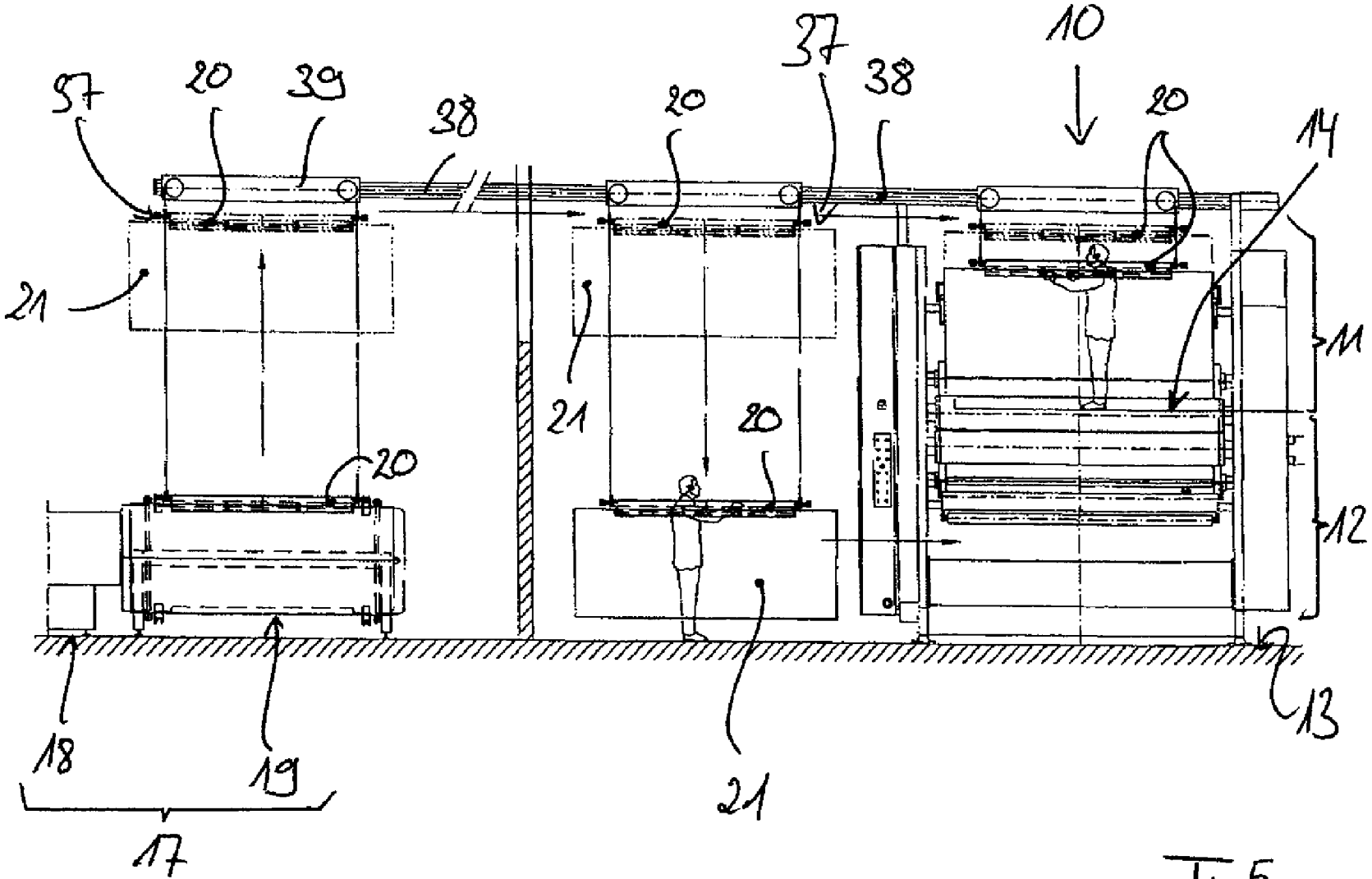
FIG. 5 shows an alternative schematic view of a printing unit of a rotary printing press together with a printing plate transporting trolley and a bending device to illustrate the method, according to the invention, for handling printing plates.

FIG. 5 shows a variant of the invention in which the printing plate transporting trolley 28 can be dispensed with. The rail 38 accordingly extends into the area of the bending device 17.

Bent printing plates can be reliably transported between the bending device 17 and the printing mechanism 10 of the printing press by means of the present invention without the risk of damaging the bent printing plates 21. In so doing, direct contact between the printing plates 21 and printing plate transporting device, particularly direct contact with the printing plate transporting trolley 28, is prevented. The printing plates 21 are fixed to a gripping bar 20 in the area of a leading end or a trailing end of the printing plates over the entire course of transporting between the bending device 17 and the printing unit 10.

The printing plates 21 remain connected to the gripping bar 20 and aligned in correct register in the gripping bar 20 over the entire transporting path. Printing plates 21 which are clamped to the gripping bar 20 can be lifted into the area of upper printing mechanisms by means of a lifting device 37. The swivelable bending table 19, by means of which a bent printing plate can be swiveled into a transfer position in the area of the bending device 17, facilitates the grasping of a bent printing plate by a gripping bar 20 in the area of a leading end or trailing end thereof.

In the same way that new printing plates are transported from the bending device 17 in direction of the printing unit 10, used printing plates can also be returned in the opposite manner.

Devices for storing and transmitting information for automatic transporting of printing plates 21 held at the gripping bars 20 can be associated with the gripping bars 20. These devices for storing and transmitting information can be, e.g., RFID tags.

The invention is not limited by the embodiments described above which are presented as examples only but can be modified in various ways within the scope of protection defined by the appended patent claims.

We claim:

1. A method for handling printing plates, the method comprising:

placing an exposed printing plate on a bending table of a bending device;

bending the exposed printing plate in the bending device to form a leading end and a trailing end;

gripping the exposed and bent printing plate in a gripping bar at one of said leading and trailing ends;

transferring the gripping bar and the printing plate gripped thereby to a transporting device;

transporting the gripping bar and the printing plate gripped thereby toward the printing press by means of the transporting device;

removing the gripping bar and the printing plate gripped thereby from the transporting device; and transferring the printing plate, while gripped by the gripping bar, from the transporting device to a form cylinder of a printing mechanism.

2. The method of claim 1 further comprising, after bending the exposed printing plate on the bending device, swiveling said one of said leading and trailing ends upward by swiveling said bending table, whereby said one of said leading and trailing ends can be gripped by said gripping bar and transferred to said transporting device.

3. The method of claim 1 wherein the transporting device is a trolley, the method further comprising, after gripping the printing plate, suspending the printing plate on the trolley by means of the gripping bar.

4. The method of claim 3 wherein the gripping bar and the plate gripped thereby are removed from the trolley by gripping the gripping bar, whereupon the printing plate is guided directly to a form cylinder accessible at floor level.

5. The method of claim 3 wherein the gripping bar and the plate gripped thereby are removed from the trolley by gripping the gripping bar, whereupon the printing plate is lifted to a gallery level and guided to a form cylinder accessible at the gallery level.

6. The method of claim 1 wherein the exposed and bent printing plate is gripped in correct register by the gripping bar, held in correct register during transporting, and transferred to the form cylinder in correct lateral and diagonal register.

* * * * *